US005339794A

United States Patent [19]

Thyssen

[11] Patent Number: 5,339,794

[45] Date of Patent: Aug. 23, 1994

[54] TOOL FOR DRESSING DOUBLE-LEAD, CYLINDRICAL GRINDING WORMS

[75] Inventor: Wolfgang Thyssen, Bad Säckingen, Fed. Rep. of Germany

[73] Assignee: Reishauer AG, Wallisellen, Switzerland

[21] Appl. No.: 157,426

[22] Filed: Nov. 26, 1993

[30] Foreign Application Priority Data

Dec. 10, 1992 [CH] Switzerland ..... 3774/92

[51] Int. Cl.[5] ..... B24B 53/075

[52] U.S. Cl. ..... 125/11.04; 51/206 R; 51/287; 51/288

[58] Field of Search ..... 125/11.04, 11.03, 11.01; 51/288, 206 R, 206 P, 206.4, 207, 325, 287, 105 GG

[56] References Cited

U.S. PATENT DOCUMENTS 4,993,194 2/1991 Cadisch ..... 51/206 R

FOREIGN PATENT DOCUMENTS 0225364 7/1985 Fed. Rep. of Germany ..... 51/105 GG 1750937 7/1992 U.S.S.R. ..... 51/206 R

*Primary Examiner*—Robert A. Rose

*Attorney, Agent, or Firm*—Sughrue, Mion, Zinn, Macpeak & Seas

[57] ABSTRACT

A tool 1 comprises a single rib dressing roll 5 and two semi-rib dressing rolls 10, 11 separated by spacers 13. The two flanks 31, 33 of a first lead 32 of a grinding worm 30 are dressed by the two flanks 6, 7 of the single rib dressing roll, and the two flanks 35, 38 of a second lead 36 are dressed by the two flanks 14, 16 of the semi-rib dressing rolls. Fast dressing with a long service life and a short dressing stroke are thus obtained.

4 Claims, 1 Drawing Sheet

TOOL FOR DRESSING DOUBLE-LEAD, CYLINDRICAL GRINDING WORMS

BACKGROUND OF THE INVENTION

To date the following solutions are known for dressing doublelead grinding worms.

a) Dress both starts of the grinding worm in succession with the advantage of uncomplicated, single rib dressing tools and the drawback of longer dressing periods and greater deviations in the dressing pitch.

b) Dress both starts of the grinding worm simultaneously with multi-rib compact dressing rolls with the advantage of short dressing periods and the drawback of the lack of subsequent machining possibilities due to space reasons, in order to compensate for inaccuracies in production or the wear of the dressing rolls, so that they have only a tool life during the service period, thus resulting in high dressing tool expenses.

c) Dress both starts of the grinding worm with two separate pairs of diamond wheels for the left and right flanks, which are oriented by means of spacers relative to the spacing of the teeth and thus combine the possibility of simultaneously dressing both starts of the grinding worm and the possibility of subsequent machining. For subsequent machining, the spacing between the two diamond wheels can be reproduced only by replacing or adjusting one spacer per set of diamond wheels. The drawback with this solution is the installation length of both sets of diamond wheels, which are arranged side-by-side and result in large dressing stroke lengths and thus longer dressing times.

SUMMARY OF THE INVENTION

The present invention is based on the problem of providing a dressing tool, which combines the advantages of the above three known dressing tools without having to accept their shortcomings. The dressing tool enables the simultaneous dressing of both starts of the grinding worm with a dressing tool of smallest possible overall length, which can be subsequently machined and thus used for multiple life time periods.

With the solution according to the invention, three dressing rolls engage with three neighboring starts of the grinding worm, so that, compared to the double-lead compact roll, which engages with two neighboring starts of the grinding worm, a negligible increase in the dressing stroke is recorded, but, compared to the double set of diamond wheels comprising two coupled single taper disks, which engage with five to six neighboring starts of the grinding worm, a significant decrease in the stroke is achieved. The single and semi-rib dressing roll is reworked by the known method in that after touching the diamond coatings the pitch is reproduced by replacing or reworking the spacers.

DETAILED DESCRIPTION OF THE PREFERRED EMBODIMENTS

Figure 1:
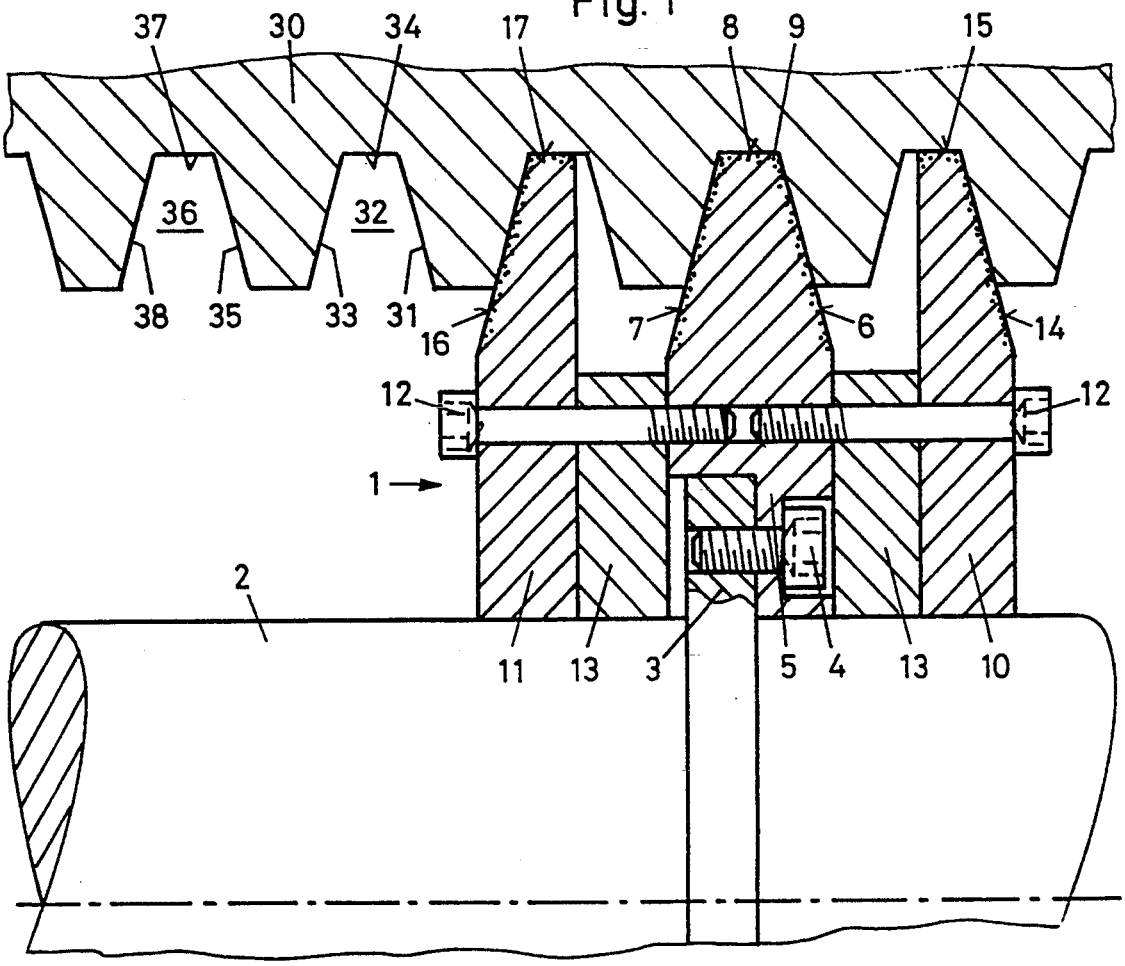
FIG. 1 is an axial, part sectional view of a dressing tool according to the invention, and part of a grinding worm.

The dressing tool 1 of FIG. 1 is mounted on a drive shaft 2 by a flange 3. To the flange 3 is fastened, by screws 4, a single rib roll 5 whose opposing two conical working flanks 6, 7 and cylindrical outer circumference are coated with diamond grains 9 or grains made of cubic boron nitride. When dressing a double-lead grinding worm 30, the flank 6 machines the one flank 31 of the first worm lead 32; the flank 7 machines the opposite flank 33; and the circumference 8, the base 34 of the lead 32.

Each half-rib roll 10, 11 is screwed with screws 12 to the single rib roll 5, with a spacer 13 with plane-parallel faces inserted between the rolls 5 and 10 or 5 and 11. The conical working flank 14 of the roll 10 machines the one flank 35 of the second lead 36 of the worm 30 and the cylindrical outer circumference 15 machines somewhat more than half of the base 37 of the lead. The roll 11 machines with its conical working flank 16, opposite the flank 14, the other flank 38 and its cylindrical outer circumference 17 machines the rest of the base 37 of the lead 36.

As an alternative to the illustrated embodiment, the rolls 5, 10 and 11 and the spacing rings 13 can also be mounted on a common bushing, instead of directly on the drive shaft 2. The rolls 5, 10 and 11 can also exhibit check flanges. The working flanks of rolls 10 and 11 can change sides, thus facing the roll 5.

Figure 2:
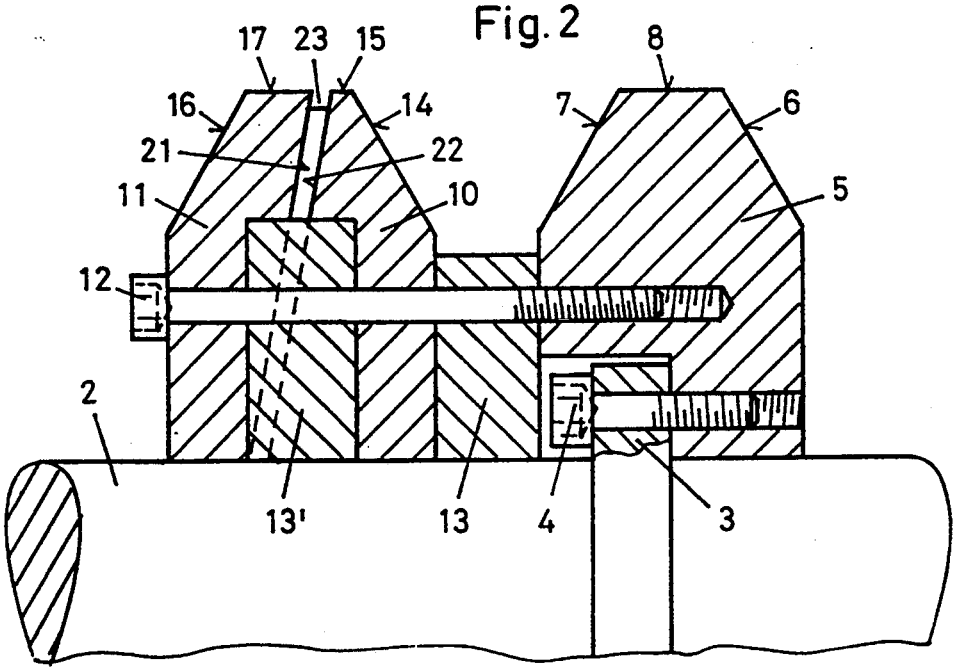
FIG. 2 shows a variation of the dressing tool according to FIG. 1.

FIG. 2 depicts a variation of the tool according to FIG. 1, wherein analogous components are provided with identical reference numerals, so that a detailed description of these parts is superfluous. The variation according to FIG. 2 is suitable for tools with a large module, and thus relatively wide peripheral areas 8, 15, 17. The two half-rib rolls 10, 11 are arranged on the same side of the single rib roll 5 and engage with the same lead 36 of the grinding worm. So that no burrs are formed on the base, the two facing, parallel faces 21, 22 of the half-rib rolls 10, 11 cut the axis of the shaft 2 at an angle of less than 90°. Therefore, the periphery of the gap 23 between the faces 21, 22 tumbles during the rotation of the shaft 2 in such a manner that it sweeps back and forth over an area that is wider than twice the width of the gap. The tangent of the angle of tilt of the faces 21, 22 relative to a radial plane thus has to be greater than the width of the gap divided by the diameter of the peripheral areas 15, 17. The variation according to FIG. 2 has the advantage that it is shorter and, therefore, requires shorter dressing strokes.

I claim:

1. A dressing tool for dressing double-lead, cylindrical grinding worms (30) for the roll grinding of spur gears, comprising:

a) a first dressing roll (5) having two opposite, conical first and second flanks (6, 7) coated with hard material grains (9) for simultaneously dressing opposing flanks (31, 33) of a first start (32) of the grinding worm, and b) coaxial second and third dressing rolls (10, 11), the second dressing roll having a conical third flank (14) coated with said hard material grains and facing one side in order to dress a flank (35) of a second start (36) of the grinding worm, and the third dressing roll having a conical fourth flank (16) and facing an opposite side in order to dress another, opposite flank (38) of the second start of the grinding worm.

2. A tool as claimed in claim 1, wherein the first, second and third dressing rolls (5, 10, 11) are mounted on a common shaft (2) or bushing.

3. A tool as claimed in claim 2, wherein the first, second and third dressing rolls are individually separated by two spacers (13).

4. A tool as claimed in claim 1, wherein the sum of the axial lengths of cylindrical outer circumferences (15, 17) of the second and third dressing rolls (10, 11) is greater than the axial length of a cylindrical outer circumference (8) of the first roll, and wherein said cylindrical outer circumferences are coated with said hard material grains.

* * * * *